US008455109B2

(12) United States Patent
Parysek

(10) Patent No.: US 8,455,109 B2
(45) Date of Patent: Jun. 4, 2013

(54) MICROWAVE COOKING TRAY WITH POP-UP LEGS

(75) Inventor: Richard M. Parysek, Pittsburg, PA (US)

(73) Assignee: H.J. Heinz Company, Pittsburgh, PA (US)

( * ) Notice: Subject to any disclaimer, the term of this patent is extended or adjusted under 35 U.S.C. 154(b) by 3 days.

(21) Appl. No.: 13/183,171

(22) Filed: Jul. 14, 2011

(65) Prior Publication Data

US 2012/0190522 A1 Jul. 26, 2012

Related U.S. Application Data

(62) Division of application No. 12/213,775, filed on Jun. 24, 2008.

(51) Int. Cl.
*B65D 1/34* (2006.01)

(52) U.S. Cl.
USPC ..... 428/542.8; 29/428; 219/725

(58) Field of Classification Search
USPC ..... 219/725, 732, 756; 29/428; 428/542.8; 426/113
See application file for complete search history.

(56) References Cited

U.S. PATENT DOCUMENTS

| | | | | |
|---|---|---|---|---|
| 4,592,914 | A | 6/1986 | Kuchenbecker | |
| 4,705,929 | A | 11/1987 | Atkinson | |
| 4,877,932 | A | 10/1989 | Bernstein et al. | |
| 4,919,785 | A * | 4/1990 | Willey et al. | 229/207 |
| 5,153,402 | A | 10/1992 | Quick et al. | |
| 5,247,149 | A | 9/1993 | Peleg | |
| 5,630,960 | A | 5/1997 | Gomez | |
| 5,948,308 | A | 9/1999 | Wischusen, III | |
| 6,359,272 | B1 | 3/2002 | Sadek et al. | |
| 2003/0230572 | A1 | 12/2003 | Kim | |
| 2007/0087090 | A1 * | 4/2007 | Russell et al. | 426/113 |
| 2007/0221669 | A1 | 9/2007 | Ly | |

FOREIGN PATENT DOCUMENTS

| | | | |
|---|---|---|---|
| EP | 0417316 | A1 | 3/1991 |
| EP | 1840047 | A1 | 10/2007 |
| JP | 2005-350079 | | 12/2005 |
| WO | WO 94/16606 | | 8/1994 |
| WO | WO 2007/033183 | A1 | 3/2007 |
| WO | WO 2007/123611 | A1 | 11/2007 |

* cited by examiner

*Primary Examiner* — Henry Yuen
*Assistant Examiner* — Jianying Atkisson
(74) *Attorney, Agent, or Firm* — Greenblum & Bernstein, P.L.C.

(57) ABSTRACT

A microwave cooking tray includes pop-up legs. The microwave cooking tray is formed from a blank including a main panel, at least two leg portions, each leg portion having a first panel connected to the main panel by a first fold line, a second panel connected to the first panel by a second fold line, and a third panel connected to the second panel by a third fold line, and an aperture located on each of the first fold line between the main panel and each of the first panels. When assembled each of the third panels lies flat against an underside of the main panel, such that each of the third panels reinforces the main panel, and the first panel and second panel extend downward from the underside of the main panel to form triangular legs resting on an edge.

6 Claims, 7 Drawing Sheets

MICROWAVE COOKING TRAY WITH POP-UP LEGS

This application claims the benefit under 35 U.S.C. §120 of the filing date of U.S. patent application Ser. No. 12/213,775, filed Jun. 24, 2008, entitled MICROWAVE COOKING TRAY WITH POP-UP LEGS, the entire contents of which is hereby incorporated herein by reference.

BACKGROUND

Cooking trays for microwave ovens typically include a main body for supporting foodstuffs and optional supports.

SUMMARY

A blank for forming a microwave cooking tray is disclosed. The blank includes a main panel; at least two leg portions each having a first panel connected to the main panel by a first fold line, a second panel connected to the first panel by a second fold line, and a third panel connected to the second panel by a third fold line; and an aperture located on each of the first fold lines between the main panel and each of the first panels. When assembled, each of the third panels lies fiat against an underside of the main panel, such that each of the third panels reinforces the main panel, and the first panel and second panel extend away from the underside of the main panel to form triangular legs resting on a line. Also, when assembled, each of the second panels extends to a central location along the underside of the main panel.

In one embodiment, the main panel further includes printed indicia printed. The main panel may also include a microwave susceptor, which may be a film adhered to the main panel or may be printed on the main panel.

Preferably, the main panel has a length and a width selected to correspond to the dimensions of a package sized to accommodate a microwave heatable food item, including without limitation an individual portion pizza. Suitable dimensions for the length and width preferably lie in the range of about 7 to about 8 inches. The blank preferably is fabricated from one piece of material and may be formed from cardstock.

In a preferred embodiment, each of the third panels includes a main body, a neck, and a tab portion. Each of the tab portions extends through a corresponding one of the apertures when assembled, such that each tab portion forms a handle when extended through the aperture. Preferably, each of the apertures includes a cutout, which acts as a finger access hole.

This disclosure also concerns a method of assembling a microwave cooking tray. The method includes the steps of forming a blank having a main panel and at least two leg portions, where each of the at least two leg portions has a first, panel attached to the main panel at a first fold line, a second panel attached to the first panel at a second fold line, a third panel attached to the second panel at a third fold line, where each of the third panels includes a main body, a neck and a tab portion, and where an aperture lies substantially centrally along each of the first fold lines. The method further includes folding the blank along each of the third fold lines, such that each of the third panels lies flat against corresponding first and second panels, and folding the blank along each of the first fold lines, such that each of the third panels lies between the main panel and corresponding first and second panels. Preferably, the method also include a method of using such a microwave cooking tray that includes the step of pulling each of the tab portions through the corresponding aperture to fold the blank along each of the second fold lines and form a microwave cooking tray.

This disclosure also describes a microwave cooking tray formed from a blank and including a main panel and at least two triangular legs. Each leg preferably includes a first panel connected to the main panel by a first fold line, a second panel connected to the first panel by a second fold line, and a third panel connected to the second panel by a third fold line. Typically, the third panel includes a tab portion. Further, the first fold line includes an aperture located at its central portion and sized to permit an end portion of the blank to pass therethrough. Each of the third panels lies flat against an underside of the main panel, such that the third panel reinforces the main panel. Each of the first panels and second panels extend downward from the underside of the main panel so that the fold line between them forms a line to support the tray. With the two sets of panels, a pair of generally parallel lines defined by the sets of first and second panels support the main panel of the tray at an elevated position relative to the supporting surface on which the parallel lines rest. In this condition, each of the tab portions extends through a corresponding one of the apertures.

The main panel further may also have indicia printed thereon. The main panel may also includes a microwave susceptor to enhance the heating effect of microwave energy on a foodstuff supported by and resting on the main panel. Typically, the microwave susceptor may be a film adhered to the main panel or may be printed on the main panel. Each tab portion protruding from the corresponding aperture forms a handle. Preferably each of the tab portions is coplanar and has a sufficient width that the tab portions can laterally stabilize the main portion from tipping when it is lifted by the tab portions. In the preferred embodiment, the at least two triangular legs raise the microwave cooking tray about 1 inch to about 2 inches above a supporting surface. Also preferably, the third panel further includes a main body portion, which is wider than the tab portion.

BRIEF DESCRIPTION OF THE DRAWINGS

Many objects and advantages of this invention will be apparent to those skilled in the art when this description is read in conjunction with the appended drawings wherein like reference numerals have been applied to like elements and wherein.

DETAILED DESCRIPTION

Figure 1:
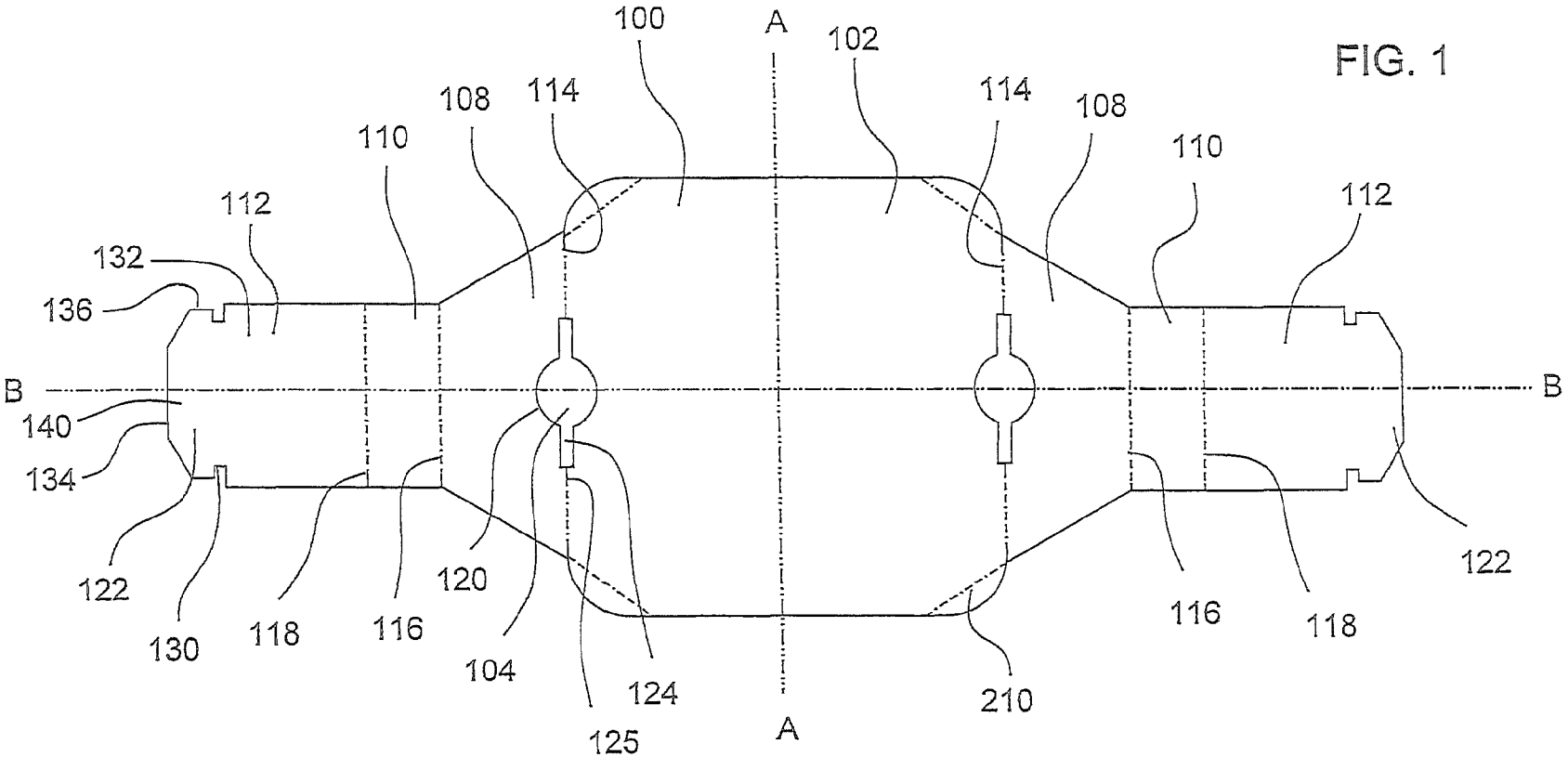
FIG. 1 is a top view of a preferred embodiment of a blank.

As described herein, a microwave cooking tray has pop-up legs and is formed from a blank. Many microwave ovens include a glass tray that holds food products off the floor of the microwave oven. However, not wishing to be bound by theory, the glass tray absorbs some microwave energy, thereby potentially lengthening cooking times and causing uneven heating of foods. Nevertheless, by elevating food products within a microwave oven above the bottom or floor of the oven, the food products may heat faster and more evenly. Microwave energy in the oven is generally reflected from the internal surfaces of the oven, including the floor—so positioning the food product away from the surface places the food product at a location where the amplitude of the microwaves is higher than at a reflection point such as the internal surface. The microwave cooking tray of this disclosure includes pop-up leg supports to elevate food products above the floor of a microwave oven when in use, but which pop-up leg supports are folded flat for packaging purposes. In addition, the microwave cooking tray is formed from a blank and is adapted for easy set-up and use.

In a preferred embodiment (see FIG. 1), the microwave tray of this invention includes a blank 100 that preferably is made from a single sheet of material. While various types of material are suitable for the blank 100, conventional card stock having a thickness of about 0.018 inches has been found to be particularly well adapted for the tray. At least a portion of the blank 100 may be coated, may be printed with designs or indicia, may include one or more microwave susceptor materials bonded or otherwise adhered to its major surface or surfaces, and may have a microwave susceptor physically attached thereto.

The blank 100 includes a main panel 102, which is sized and configured to support a food item, such as a personal-sized pizza, a sandwich, egg rolls, taquitos, pastries, and the like. Moreover, the blank 100 is sized to be received in a corresponding box or carton that may be shaped as a parallelopiped. In a preferred embodiment, the width and length of the main panel 102 are sized to support a food item and typically have dimensions in the range of about 7 to about 8 inches. In one typical preferred embodiment, the width and length of the main panel 102 are each independently about 7.25 inches when the main panel 102 is designed for use with single serving foods, such as individual personal pizzas, Ordinarily, the width and length will exceed the nominal dimensions of the food stuff to accommodate variations in the nominal dimensions that occur during production and so that the food product is fully supported by the main panel 102. Additionally, the main panel 102 is sized so that the microwave tray can fit in standard packaging materials.

The main panel 102 can be square (see FIG. 2), rectangular, round, or oval in shape. However, the main panel 102 (see FIG. 1) is preferably substantially square in shape with rounded, generally arcuate corners. The use of rounded corners may reduce the amount of material needed to form the blank 100. Moreover, the use of rounded corners facilitates insertion of the microwave tray into and removal from surrounding packaging by eliminating or reducing sharp points or projections.

The blank 100 is preferably substantially symmetrical about a transversely extending axis of symmetry A-A and substantially symmetrical about a longitudinally extending axis of symmetry B-B. Among other things, the symmetrical arrangement of the blank enhances both ease of use by the consumer and packaging, the latter because there is no required orientation of the tray in a surrounding package. Moreover, the symmetrical arrangement with respect to the two generally perpendicular axes of symmetry A-A, B-B enhances stability of the tray when used to support a food item in a microwave oven.

The blank 100 may range in length along the axis B-B from about 19 inches to about 22 inches, more preferably about 20 inches to about 21 inches. In the preferred embodiment, the length of the blank 100 may be about 20.438 inches. The width at the widest portion of the blank 100—typically located at about the axis of symmetry A-A, ranges from about 7 inches to about 8 inches. In the preferred embodiment, the width at the widest portion of the blank 100 is about 7.25 inches. The principal width at the narrowest part of the blank 100 is selected to lie in the range of about ⅓ to ½ of the width of the widest portion of the blank 100 so that the legs of the tray formed in preparation for use can stably support the main panel of the tray. At each end of the blank 100, remote from the main panel 102, a tab 122 is provided that may have a width in the range of from about 1 inch to about 3 inches. In the preferred embodiment, the width of the tab portion 122 of the blank 100 may be about 1.5 inches.

At each side edge of the main panel 102, generally parallel to the transverse axis of symmetry A-A, a corresponding fold line 124 defines the separation between the main panel 102 and a corresponding leg portion 106. The fold line 124 may, for example, be a score line in the blank 100. Each opposed peripheral edge of the main panel 102 includes an aperture 104. Each aperture 104 preferably straddles the corresponding fold line 114 and preferably is symmetrically located on the fold line 114 and along the longitudinal axis of symmetry B-B. Each end of the aperture 104 preferably includes a generally rectangular notch 124 generally aligned with the corresponding fold line 114 and generally straddling that fold line 114. The notches 124 preferably have a width measured in the direction of the axis of symmetry B-B that exceeds the thickness of the material from which the blank is fabricated. Moreover, the length between the ends of the notches 124 along the fold line 114 is preferably selected to exceed the minimum width of the tab portion 106. For example, the length between the ends of the notches 124 may be about 3 inches and the width of the notches 124 may be about 0.188 inches.

Each aperture 104 preferably includes a cutout 120 that can be square, oval, round, elliptical, or football-shaped. In a preferred embodiment, the cutout 120 has rounded corners so that there are no sharp edges or corners that could cut or otherwise injure a user's finger. Thus, the cutouts may preferably be formed from symmetrically disposed curved lines, that may be arcuate or generally circular. The maximum width of the cutout 120, measured perpendicular to the corresponding fold line 114, preferably is selected to be at least twice the distance required to pinch an object between the thumb and forefinger. Preferably, the cutout 120 is positioned centrally along the length of the corresponding aperture 104. While it is presently preferred that the cutouts 120 be symmetrical in alternate embodiments, the cutouts 120 need not be symmetrical.

Extending from each notch 124 along the corresponding fold line 114 and away from the cutout 120 is a slit 125 in the cardstock. The distance between the distal ends of the opposed pairs of slits 125, measured along the corresponding fold line 114, preferably is greater than the width of the tab portion 122, but less than the width of the leg portion 106. In this way, the aperture 104 can be effective to limit the range of motion for the tab portion as will be described further below.

Each leg portion 106 of the blank 100 (see FIG. 1) includes three portions and a corresponding tab portion 122. More particularly, each leg portion 106 includes a first panel 108, a second panel 110, and a third panel 112. The first panel 108 is attached to a corresponding side of the main panel 102 at a corresponding first fold line 114, such that the aperture 104 is substantially centrally located between the main panel 102 and the first panel 108. In a preferred embodiment, the first panel 108 may be generally trapezoidal in shape. In alternate embodiments, the first panel 108 may be generally rectangular or generally square in shape. In the preferred embodiment, each first panel 108 is symmetrical to the other first panel 108 across axis of symmetry A-A' so that the tray will be balanced and stable when assembled or erected.

Preferably, the length of the first panel measured along the axis of symmetry B-B ranges from about 2 to about 3 inches. In the preferred embodiment, the length of the first panel is about 2.094 inches in length. The width of the first panel 108 at the first fold line 114 (major edge of the main panel 102) preferably is less that the width of the main panel 102 but greater than the minimum width of the leg portion 106. More preferably, the width of the first panel 108 ranges from about 4 inches to about 7 inches, even more preferably about 5 inches to about 6 inches. In the most preferred embodiment, the width of the first panel 108 at the first fold line 114 is about 5.25 inches. The width of the first panel 108 at the first fold line 114 is chosen so that the weight of a food product resting on the microwave cooking tray, when assembled, is transmitted to legs formed from the leg portions 106, as will be described below.

A second fold line 116 is defined between the first panel 108 and the second panel 110. The second fold line 116 may be a score line in the material of the blank 100. The width of the first panel 108 at a second fold line 116 (minor edge of the first panel 108) may range from about 2.5 to about 4 inches, more preferably about 3 to about 4 inches. In the preferred embodiment, the width of the first panel 108 at the second fold line 116 may be about 3.25 inches. Preferably, the major edge and the minor edge of the first panel 108 are narrower than the width of the main panel 102 so as to reduce cost, weight of the microwave tray, and maximize use of materials used to form the tray. However, in alternate embodiments, the major edge and the minor edge of the first panel 108 may have the same width or a larger width than the main panel 102, features which may provide greater support when the microwave tray is intended to be used with heavier food stuffs.

The second panel 110 connects the first panel 108 to the third panel 112. The second panel 110 can be generally rectangular, generally square, or generally trapezoidal in shape. Preferably, however, the second panel 110 is substantially rectangular in shape. The second panel 110 is connected to the first panel 108 at the second fold line 116 and to the third panel 112 at a third fold line 118. The third fold line 118 may be a score line in the blank 100. Moreover, the three fold lines 114, 116, 118 preferably are generally parallel to one another. The length of the second panel measured along the axis B-B may range from about 1 inch to about 2 inches. In the preferred embodiment, the length of the second panel is about 1.219 inches. The width of the second panel 110 measured generally parallel to the axis A-A ranges from about 2.5 to about 4 inches, more preferably about 3 to about 4 inches. In the preferred embodiment, the width of the second panel 110 is about 3.25 inches. Preferably, the width of the second panel 110 at the second fold line 116 is selected to be in the range of ⅓ to ¾ of the width of the main panel 102 so that pop-up legs of the microwave tray provide substantial support for the main panel 102.

Preferably, when the first panel 108 is trapezoidal in shape, the width of the second panel 110 is less than the width of the major edge of the first panel 108 so as to reduce the use of materials. When the first panel 108 is rectangular in shape, preferably, the width of the first panel 108 is the same as the width of the second panel 110.

The third panel 112 is connected to the second panel 110 along the third fold line 118. The third panel 112 includes the tab portion 122 that extends from a side of the third panel 112 opposite from the third fold line 118. The tab portion is integrally formed with the material of the third panel 112. The tab portion is attached to the third panel 112 by a neck 130, which is narrower in width than the base 140 of the tab portion 122, and which is also narrower in width than the third panel 112. The width of the third panel 112 ranges from about 2.5 to about 4 inches, more preferably about 3 to about 4 inches. In the preferred embodiment, the width of the main body 132 of the third panel 112 is about 3.25 inches. The width of the base 140 of the tab portion 122 ranges from about 2 inches to about 3 inches. In the preferred embodiment, the width of the base 140 of the tab portion 122 is about 2.75 inches.

The tab portion 122 can include a narrowed end portion or point 134 at the end. The point 134 may be about 1 to about 2 inches in width. In the preferred embodiment, the point 134 is about 1.5 inches in width. Preferably, the length of the third panel 112 measured between the distal end and the third fold line 118 is slightly less than the length of the first panel 108 plus the length of the second panel 110, so that when the third panel 112 is folded over the first panel 108 and the second panel 110, the tab portion 122 extends to the aperture 104. Preferably length of the third panel 112 is about 99% of the combined length of the first panel 108 and the second panel 110.

In a second embodiment (see FIG. 2), the main panel 102 of the blank 100 is generally square in shape and has generally sharp, square (as in 90°) corners. Each first panel 108 is attached to the main panel 102 at the corresponding first fold line 114. The width of the first panel 108 at the first fold line 114 measured in the direction parallel to the axis of symmetry A-A is substantially the same as the width of the main panel 102. As shown, the first panel 108 is generally trapezoidal in shape and is attached to a second panel 110 at the second fold line 116. The width of the first panel 108 at the second fold line 116 is substantially the same as the width of the second panel 110 so as to provide sufficient support to the main panel 102 when assembled. The second panel 110 is attached to the third panel 112 at the third fold line 118. The main body 132 of the third panel 112 has substantially the same width as the second panel 110. The third panel 112 also includes a tab portion 122 that has a narrower width than the main body 132 of the third panel 112. The length of the third panel 112 is substantially the same as the combined lengths of the first panel 108 and the second panel 110 as discussed above—i.e., the length of the third panel 112 is about 99% of the combined length of the first and second panels 108, 110.

Figure 3:
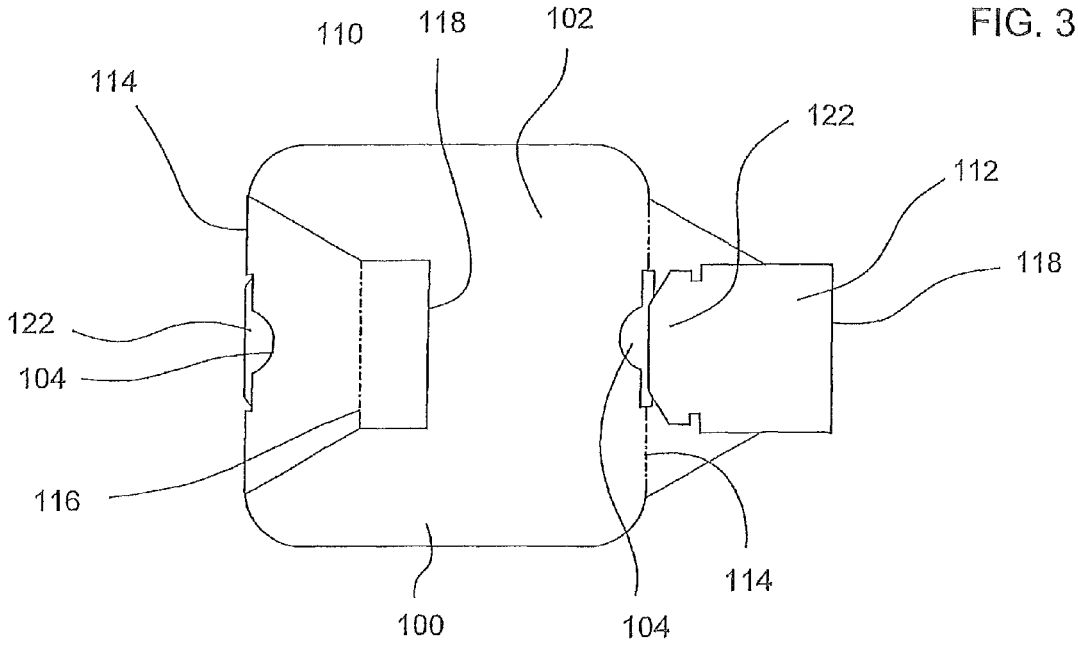
FIG. 3 is a bottom view of the microwave cooking tray with pop-up legs formed from the blank of FIG. 1 being assembled.
Figure 4:
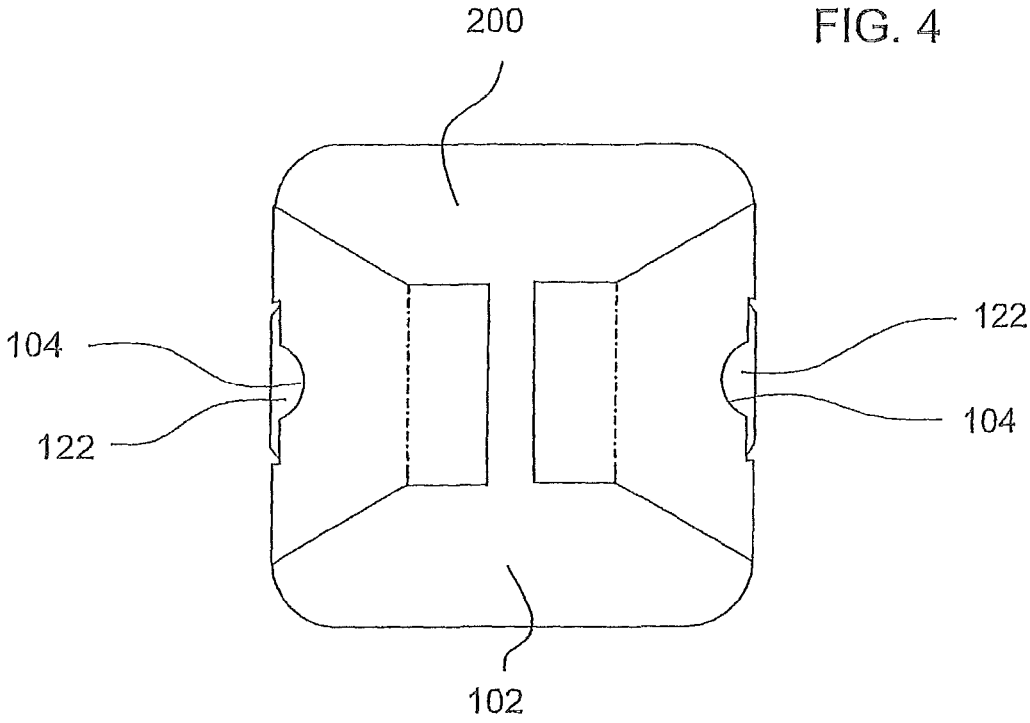
FIG. 4 is a bottom view of the microwave cooking tray with pop-up legs formed from the blank of FIG. 1 after assembly.
Figure 5:
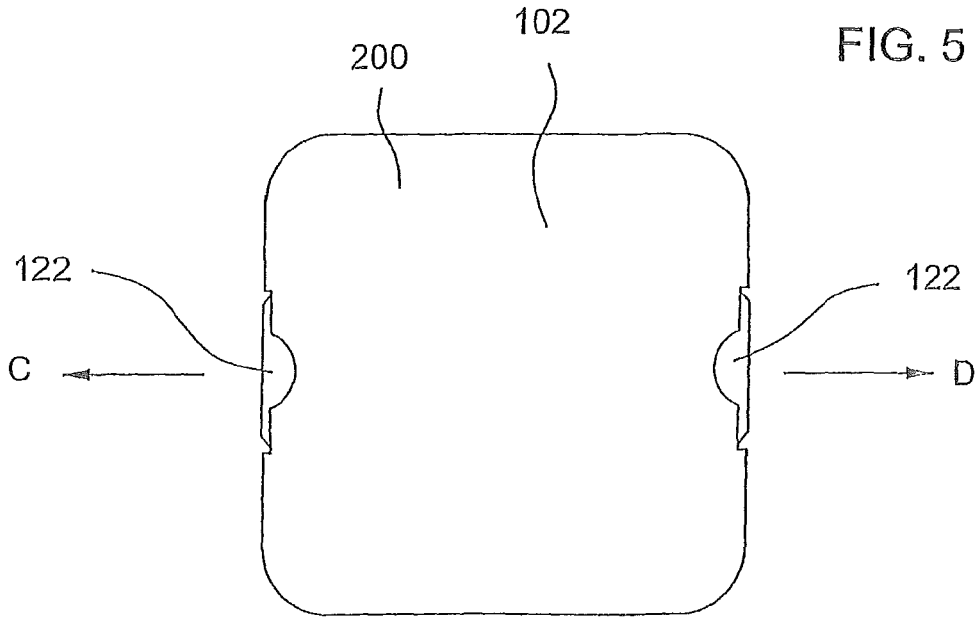
FIG. 5 is a top view of the microwave cooking tray with pop-up legs formed from the blank of FIG. 1 after assembly.

Assembly of the microwave cooking tray 200 is easily accomplished as shown in FIGS. 3-5. To assemble the microwave cooking tray 200 (see FIG. 3), each third panel 112 is folded over the integrally attached second panel 110 and the corresponding first panel 108 at the third fold line 118. This step is shown on one side of FIG. 3, it being understood that both third panels of the blank 100 are similarly folded. Next, the first panel 108 and the second panel 110 are folded over the third panel at the corresponding first fold line 114, such that the third panel 112 lies against the main panel 102 and between the main panel 102 and the first panel 108 and second panel 110. Because the length of the third panel 112 is slightly less than the combined length of the first panel 108 and the second panel 110, the tab portion 122 extends to the aperture 104 (see FIG. 3). Here again, it is understood that the same step is performed at each side of the main panel 102. When these steps are completed, the pop-up tray assembly 200 has opposed tab portions 122 accessible through corresponding apertures 104. Preferably, the above steps are done prior to packaging of one or more food items on the pop-up tray assembly 200.

Figure 7:
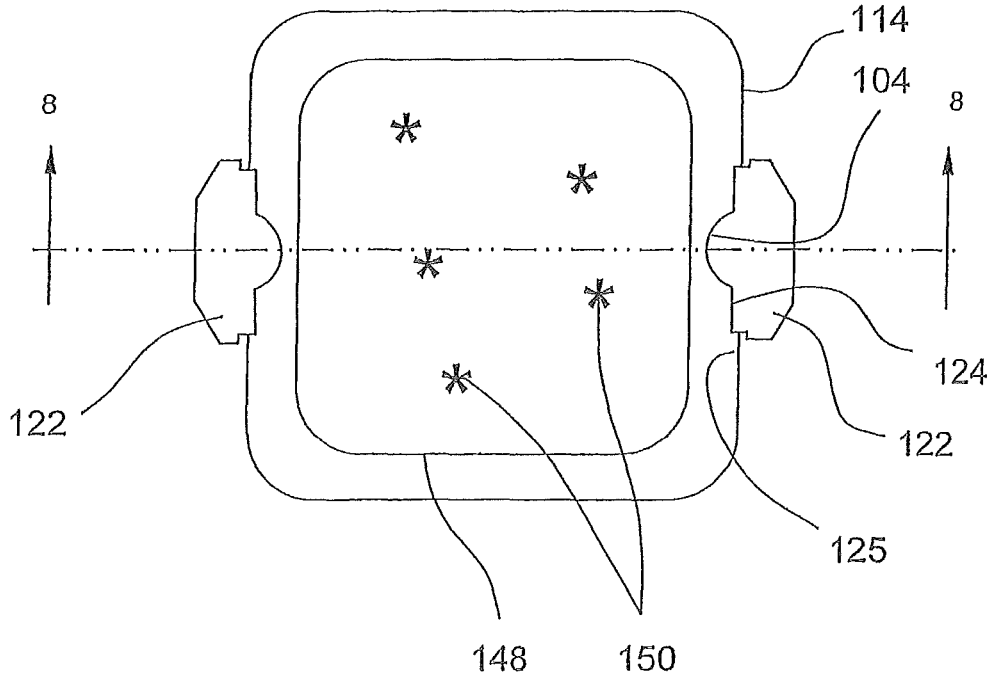
FIG. 7 is a top view of an embodiment of a microwave cooking tray with pop-up legs formed when ready for use.

The top of the main panel 102 (see FIG. 5) may be plain as shown, or may have indicia 150 printed thereon (see FIG. 7). If desired, a microwave susceptor material 148 may be printed on the top of the main panel 102, or may be fixed thereto in any conventional manner. Further, if desired, the microwave susceptor material 148 may have a pattern to enhance its interaction with and selective heating of the foodstuff.

In use, the flat pop-up microwave tray 200 (see FIG. 5) has one or more food items placed thereon and further enclosed in a surrounding package (not shown) that may be slightly larger in width and length than the tray 200 and which has a height exceeding the height of the food items. Such a package may be shaped as a generally rectangular parallelopiped, or a generally rectangular prism.

When a consumer of the food items wants to cook those food items in a microwave, the tray 200 is removed from the surrounding package (see FIG. 5) with the food item(s) on top of the main panel 102. Then, the consumer grasps the exposed portions of the tabs 122 with fingers of each hand and pulls the tabs 122 outwardly (in the direction of the arrows C, D). That action pulls each tab portion 122 through the corresponding aperture 104, notches 124, and slits 25 on the corresponding first fold line 114 (see FIG. 7). Because the width of the main body 132 of the third panel 112 is wider than the combined width of the aperture 104, the notches 124, and the slits 125 (see FIG. 1), as the tabs 122 are pulled outwardly (see FIG. 7), the main body 132 of the third panel 112 abuts the first fold line 114 to stop the consumer from pulling the tab portion 122 further outwardly away from the body portion 102. Thus, the interaction between the tab portions 122 and the corresponding aperture 104 structure limits the distance the tabs 122 can be pulled and assures that both tabs 122 move the same distance.

Figure 8:
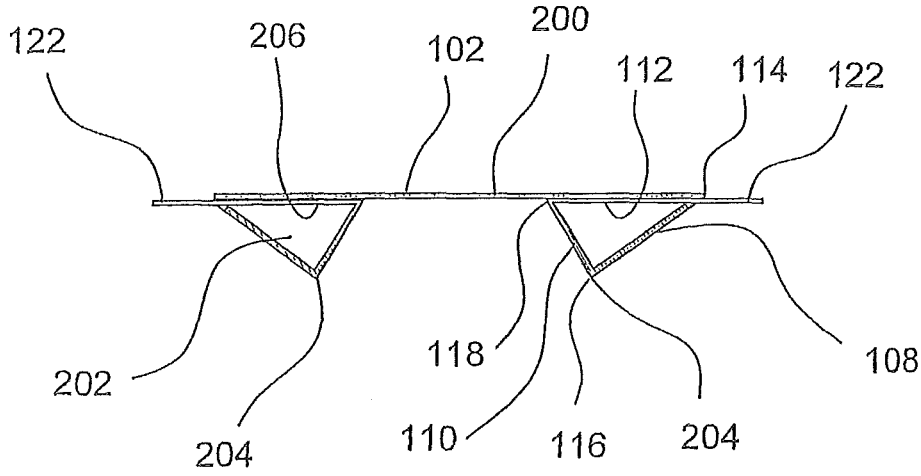
FIG. 8 is a cross-sectional view of the microwave cooking tray with pop-up legs taken along the line 8-8 of FIG. 7.

Simultaneously, as the tab portions 122 are pulled outwardly (see FIG. 6), the third fold line 118 of each leg portion moves away from the center of the main panel 102 and toward the first fold line 114 by a distance corresponding to the distance through which the tab portion 122 moves. That movement of the third fold line 118 causes the first panel 108 and the second panel 110 to bend along the second fold line 116 so that the second fold line 116 moves downwardly away from the plane of the main panel 102 (see FIG. 8), so that a pair of generally triangular legs 202 are erected. The main body 132 of each of the third panels 112 becomes the hypotenuse 206 of each of the corresponding triangular leg 202. The first panel 108 and the second panel 110 form shorter sides of the triangular leg 202, such that the microwave cooking tray 200, when placed upright (as shown in FIG. 8), rests on an edge 204 of each triangular leg 202. Preferably, the edges 204 of each triangular leg 202 are parallel to one another and spaced from one another by a distance exceeding 50% of the length of the main panel 102, so that the main panel 102 of the microwave tray is fully supported when the triangular legs have been popped-up. The edges 204 are formed at each second fold line 116. Preferably, the width of the second fold line 116 is sufficient to provide a wide enough edge to keep the microwave tray stable when in use.

Additionally, because the main panel 102 of the microwave cooking tray 200 rests on the hypotenuse 206 (second fold line 116) of each triangular leg 202, the tray 200 is reinforced by the presence of a double thickness of material and a greater weight of food can be supported by the legs 202 than a tray without the structure of this disclosure. When assembled, the second panel 110 is a short leg of each triangular leg 202 and is located adjacent a central position on the underside of the main panel 102. Since a user simply pulls the tabs 122 through the aperture 104 to assemble erect the pop-up legs 202, no adhesives are needed for assembly.

With the arrangement of this microwave tray, the main panel 102 of the microwave cooking tray 200 can be elevated about 1 inch to about 2 inches above the surface on which the microwave cooking tray 200 rests. Since the tray 200 is elevated, microwaves can circulate above and beneath the tray when cooking to more evenly distribute heat.

Because the microwave cooking tray 200 is formed from a blank 100, the cooking tray 200 can be shipped flat as a blank (see FIG. 1), or can be folded to produce the generally planar tray of FIG. 5. Either way, the pop-up legs of the tray 200 can easily be erected prior to use in a microwave by simply pulling the tabs 122 through the corresponding apertures 104.

As noted, the fold lines 114, 116, 118 can be scored to ease and localize folding between panels at the fold lines during assembly. In an alternate embodiment, the fold lines 114, 116, 118 need not be scored.

As shown in FIG. 5, a top view of a microwave cooking tray 200 prior to assembly is shown. A consumer grasps the tab portions 122 on each side of the main panel 102 through the cutouts 120 in the aperture 104 and pulls. The tab portions then pass through the aperture 104 and notches 124 to form the legs. The tab portion 122 of the third panel 112 is pulled through the aperture 104, notches 124, and slits 125, such that the neck 130 of the tab portion lies within the area of the aperture 104 when assembled. Because the aperture 104 does not extend the full width of the base 140 of the tab portion 122, the corners 136 of the tab portion slide through the slits 125 on each side of the aperture 104. Since the slits 125 are along the fold line 114, once the tab portion 122 slides through the slits 125, the tab portions 122 do not easily slide back through, thus locking or retaining the legs 202 in their elevated, pop-up configuration.

Stated differently, because the point 134 of the tab portion 122 is narrower than the base 140 of the tab portion 122, the point 134 easily slides through the aperture, while the base 140 is frictionally engaged and will not easily retreat back through the aperture after being pulled therethrough. Because the base 140 of the tab portion 122 has a wider width than the neck 130, in use the corners 136 at the base 140 of the tab portion 122 act as a locking mechanism to prevent the tab portion 122 from sliding through the aperture 104 once the tab portion 122 is pulled completely through the aperture 104 during assembly. Also, because the aperture 104 is slightly less wide than the base 140 of the tab portion 122 and the notches 124 are simple cuts in the first fold line 114, the tab portion 122 cannot easily slide out of place through the aperture 104 in conjunction with the notches 124.

Figure 6:
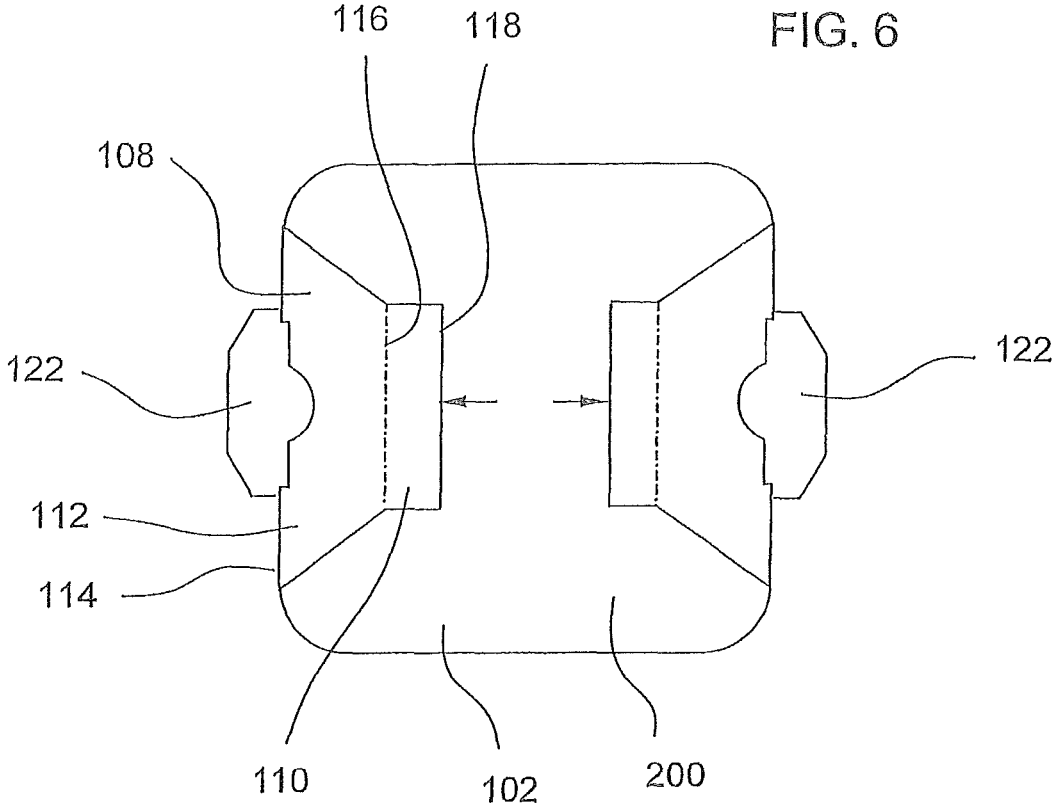
FIG. 6 is a bottom view of the microwave cooking tray with pop-up legs formed from the blank of FIG. 1 when ready for use.

As shown in FIGS. 5-7, the tab portions 122 on each side of the main panel 102 form handles, which can be used to lift, carry, and/or maneuver the microwave cooking tray 200.

Referring now to FIG. 7, in a preferred embodiment a microwave susceptor 142 can be printed or attached to the mail panel 102 for crisping and browning of food products.

For instance, the susceptor 142 can be in the form of a susceptor film 146, which can be attached to the main panel 102. The susceptor film 146 can be attached to the main panel 102 using a suitable adhesive. Preferably, the susceptor 142 is the same size or smaller than the main panel 102. The susceptor can be printed 148 on the main panel 102 in a pattern or as a solid mass on the main panel 102. In other embodiments, the susceptor is not included when browning and/or crisping of the food products is not desired.

In one embodiment, indicia 150 can be printed in ink on the cardstock for visual appeal. Preferably, the ink used to print indicia 150 on the card is food safe, such that the ink does not contaminate food products used in conjunction with the microwave cooking tray. The ink can be any color, as desired. The ink can change colors when heated. Preferably, the ink does not burn or scorch, and does not alter the taste or cooking of the food products. The indicia 150 may be simple aesthetically pleasing patterns and pictures and/or can include advertisements. The indicia 150 can be used with or without microwave susceptors.

In other embodiments, the blank may be formed from other microwaveable materials, such as heat resistant plastics, that are not subject to scorching, burning, melting, deformation, and the like when exposed to microwave heating energy. Preferably, these alternative materials are also safe for use with foods.

As shown in FIG. 7, when assembled, the microwave cooking tray 200 is substantially symmetrical about the transverse line 8-8, as well as about a generally perpendicular axis of symmetry. Because the microwave cooking tray is substantially symmetrical in two perpendicular directions, the tray is stable when in use.

In another preferred embodiment, the blank may be formed from a single piece of cardstock. Preferably, the cardstock is sufficiently heavy to form a microwave tray capable of supporting food products weighing up to about 10 ounces, and more preferably up to about 8 ounces (e.g., up to about 7 ounces, up to about 6 ounces, up to about 5 ounces, up to about 4 ounces, up to about 3 ounces, up to about 2 ounces, or up to about 1 ounce). Suitable cardstocks include, without limitation, SBS.018. The cardstock can be any color. Preferably, the cardstock is safe for use with food products and for use in microwave ovens, and does not scorch, burn, or deform in microwave heat. In a further embodiment, the cardstock may include a food-safe coating. Preferably, any such coatings are microwave safe.

Figure 2:
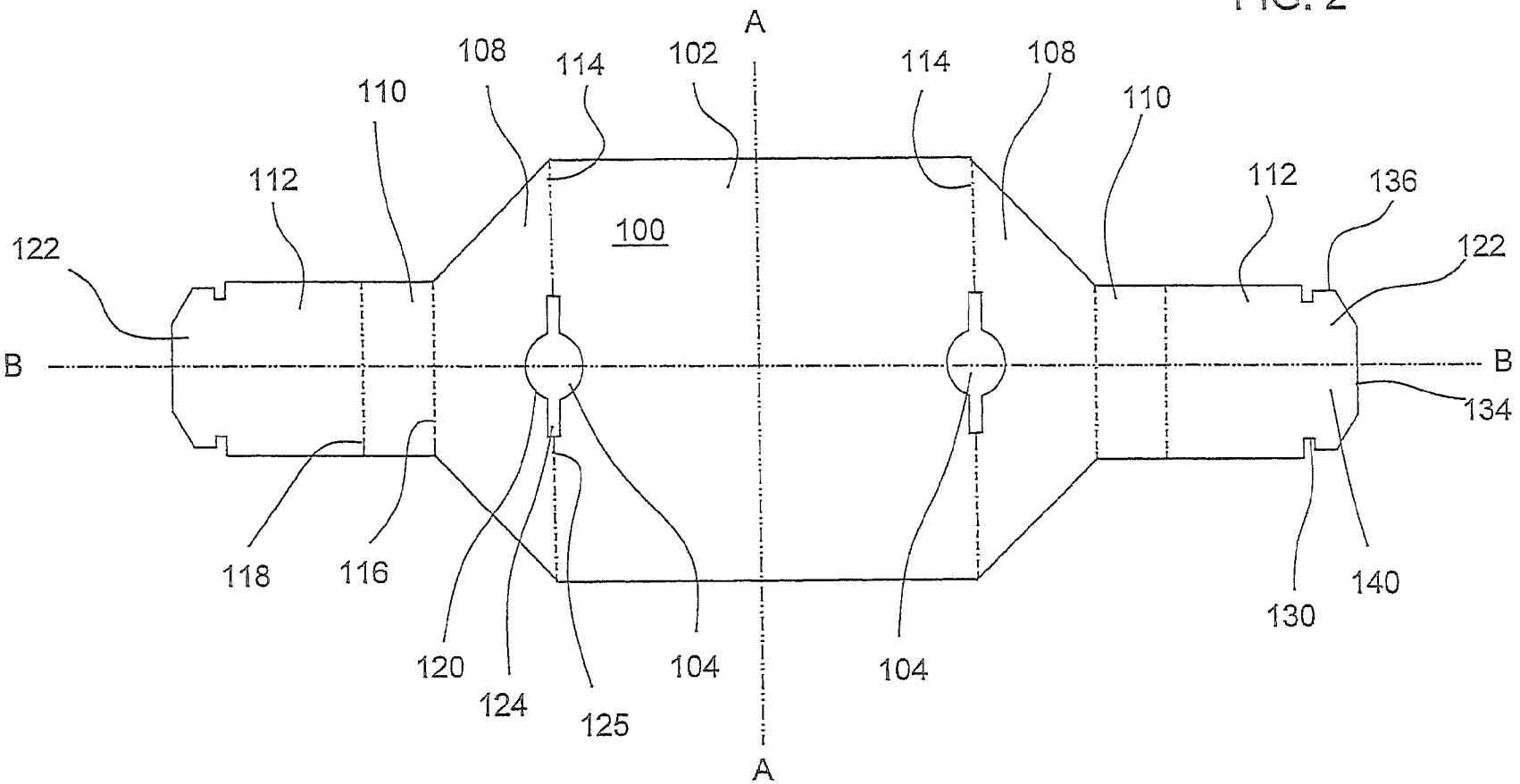
FIG. 2 is a top view of a second embodiment of a blank.
Figure 9:
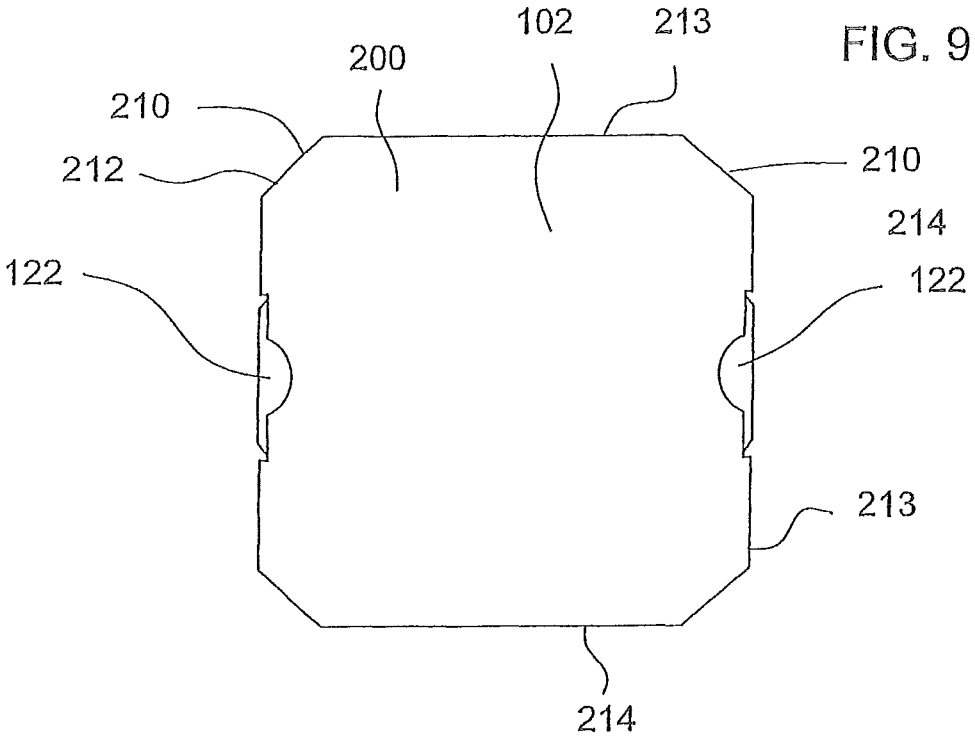
FIG. 9 is a top view of a microwave cooking tray with pop-up legs further including corner supports for product stability.
Figure 10:
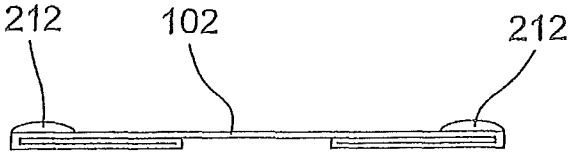
FIG. 10 is an end view of the microwave cooking tray of FIG. 9.

In another embodiment, as shown in FIG. 1 and FIG. 9, the main panel 102 of the blank 100 can include score lines 210 adjacent at one or more corners 212 of the main panel 102. Preferably, the score lines 210 are adjacent each corner 201 of the main panel. The score lines 210 function to allow a consumer to easily fold the corners 201 of the main panel 102 up during use to provide stability to the food product resting on the main panel 102 and resist the possibility that the food product can slide off the tray before or after cooking. Preferably, the score lines run diagonally (from a first edge 213 to a second edge 213) across at least one corner 212 of the main panel 102 (e.g., at least two corners, at least three corners, or at least four corners).

In another embodiment, the corners 212 can be folded up at the score lines 210 during the product fill process in which the food product is placed on the tray and packaged. When the corners 212 are folded before product fill, the corners 212 can help position the food product on the tray during the process. In addition, because the corners 212 can be folded up before packaging, when shrink-wrapped, the corners 212 provide an easy point of entry for consumers as compared to shrink-wrapping around a virtually flat product with no corners and no points at which to easily grab onto the shrink-wrap.

In this specification, the word "about" is often used in connection with numerical values to indicate that mathematical precision of such values is not intended. Accordingly, it is intended that where "about" is used with a numerical value, a tolerance of 10% is contemplated for that numerical value. Moreover, when the word "generally" is used in connection with geometric shapes, it is intended that precision of the geometric shape is not required but that latitude for the shape is within the scope of the disclosure.

While the foregoing describes in detail an microwave tray with consumer activatable pop-up legs, it will be apparent to one skilled in the art that various changes and modifications may be made to the disclosed tray and methods and further that equivalents may be employed, which do not materially depart from the spirit and scope of the invention. Accordingly, all such changes, modifications, and equivalents that fall within the spirit and scope of the invention as defined by the appended claims are intended to be encompassed thereby.

What is claimed is:

1. A method of assembling a microwave cooking tray comprising:

forming a blank comprising a main panel and at least two leg portions, each of the at least two leg portions comprising a first panel attached to the main panel at a first fold line, a second panel attached to the first panel at a second fold line, a third panel attached to the second panel at a third fold line, each of the third panels comprising a main body, a neck and a tab portion, and an aperture lying substantially centrally along each of the first fold lines;

folding the blank along each of the third fold lines, such that each of the third panels lies flat against each of the first and second panels; and folding the blank along each of the first fold lines, such that each of the third panels lies between the main panel and each of the first and second panels, wherein the third panel has a length measured between a distal end and the third fold line of about 99% of a combined length of the first panel and the second panel, such that when the third panel is folded over the first panel and the second panel, the tab portion extends to the aperture.

2. The method of claim 1, further including pulling each of the tab portions through each of the apertures to fold the blank along each of the second fold lines and form a microwave cooking tray.

3. The method of claim 2, wherein each of the tab portions forms a handle.

4. The method of claim 2, wherein each of the tab portions is coplanar.

5. The method of claim 1, wherein the blank is symmetrical.

6. The method of claim 1, further including folding upwardly at least one corner of the main panel at a score mark.

* * * * *

UNITED STATES PATENT AND TRADEMARK OFFICE

CERTIFICATE OF CORRECTION

PATENT NO. : 8,455,109 B2
APPLICATION NO. : 13/183171
DATED : June 4, 2013
INVENTOR(S) : Richard M. Parysek It is certified that error appears in the above-identified patent and that said Letters Patent is hereby corrected as shown below:

On the title page, item [75], inventor's residence, change "Pittsburg" to --Pittsburgh--.

Signed and Sealed this
Seventh Day of January, 2014

Margaret A. Focarino

Margaret A. Focarino
*Commissioner for Patents of the United States Patent and Trademark Office*